US005509545A

United States Patent [19]

Banke

[11] Patent Number: 5,509,545

[45] Date of Patent: Apr. 23, 1996

[54] VALET FOR WOMEN'S CLOTHING

[75] Inventor: Cheri L. Banke, Woodridge, Ill.

[73] Assignee: Mon Cheri, Inc., Woodridge, Ill.

[21] Appl. No.: 226,491

[22] Filed: Apr. 12, 1994

[51] Int. Cl.[6] ..... A47B 43/00

[52] U.S. Cl. ..... 211/205; 223/120

[58] Field of Search ..... 248/914; 211/205, 211/204, 196, 33, 37; 223/88, 120

[56] References Cited

U.S. PATENT DOCUMENTS

| | | | |
|---|---|---|---|
| 896,990 | 8/1908 | Hill | 211/196 X |
| 1,012,518 | 12/1911 | Cain . | |
| 1,176,563 | 3/1916 | Johnson | 211/196 |
| 1,292,931 | 1/1919 | Van Etten | 211/196 |
| 1,652,571 | 12/1927 | Hassa . | |
| 1,658,882 | 2/1928 | Cantrell et al. . | |
| 3,150,776 | 9/1964 | Van Dusen . | |
| 3,184,066 | 5/1965 | Van Dusen . | |
| 4,792,071 | 12/1988 | Scarpa et al. . | |
| 4,871,098 | 10/1989 | Bredeweg et al. | 223/85 |
| 5,022,569 | 6/1991 | Beaulieu . | |

FOREIGN PATENT DOCUMENTS

| | | | |
|---|---|---|---|
| 1423902 | 2/1976 | United Kingdom | 223/85 |

*Primary Examiner*—Ramon O. Ramirez
*Attorney, Agent, or Firm*—Banner & Allegretti, Ltd.

[57] ABSTRACT

A temporary clothing hanging structure or valet is disclosed. More particularly, a free standing valet suitable as bedroom furniture and designed for women's clothes is described. The valet comprises at least two cantilevered support members having attached hanger assemblies that accept a women's blazer, blouse and skirt, the valet also provides a purse holder and a shoe rack.

7 Claims, 1 Drawing Sheet

VALET FOR WOMEN' S CLOTHING

FIELD OF THE INVENTION

The present invention relates to a garment hanging device or so-called clothing valet, more particularly to a valet for women's clothes.

BACKGROUND OF THE INVENTION

Valet stands, generally made of wood or metal and of attractive design, have gained much popularity as bedroom furniture that allow for the temporary hanging of clothes, more typically men's suits. Such structures generally comprise a free standing frame having affixed thereto a coat or jacket hanger and a trouser-supporting bar. More interestingly, all such prior designs take into account structures that are only needed to hang a traditional men's suit. None of the designs address the particular needs associated with suits worn by women. For example, U.S. Pat. No. 1,658,882 issued to Cantrell et al. discloses a simple valet designed for hanging either a coat or dress, yet being adjustable in height to support the garment above the floor surface. Likewise, U.S. Pat. Nos. 3,150,776 and 3,184,066, both issued to Van Dusen teach a valet design for men's clothes, i.e., coat and trousers only. The valets described feature a removable hanger assembly that allows the trousers to be easily hung over the coat. To applicant's knowledge there exists no valet design that adequately provides the temporary hanging support for women's suit clothes, i.e., blazer, skirt and blouse.

OBJECTS OF THE INVENTION

It is a general object of this invention to provide a valet design especially for a women's wardrobe, in particular a blouse, skirt and blazer.

Another object is to provide a temporary support for not only women's suit clothes, but also for her shoes and purse.

Yet another object of the present invention is to provide a support structure that allows women's clothes, including shoes, to receive the proper "airing out" before being put away in a closet.

A further object of the present invention is to provide a novel valet for women's clothes which is capable of being mass-produced on an economical basis.

Yet still another object is to provide a valet design that will support a women's freshly pressed suit so that it will not get wrinkled prior to wearing.

Other objects and advantages of this invention will be readily apparent from the following summary of the invention, description of the drawings and detailed description of a preferred embodiment.

SUMMARY OF THE INVENTION

The present invention is directed to a free standing valet, fashionably designed for suitable use as a piece of bedroom furniture. More particularly, this invention is directed to a valet comprising an upper portion and a lower portion, said upper portion having a front support and a rear support, said front support having a first hanger assembly and a purse holder, said rear support having a second hanger assembly and a skirt attachment, and said lower portion having attached supporting legs and a shoe rack.

The materials of construction could be wood, plastic, metal or a combination of these. Indeed, the valet of this invention could be fabricated from any material that has sufficient strength to support the weight of a set of women's clothes. The preferred material of construction is polished brass tubing.

In its most basic design, the valet of this invention comprises a central vertical support structure having attached at its lowest end a set of support legs. At the uppermost end of the central vertical support structure are at least two opposite facing support members, each having attached a hanger assembly. The central vertical support structure also has attached to it a purse holder. The support legs comprise a sufficient number of outwardly projecting members to provide stability to the central vertical support structure when the hanger assemblies are supporting clothes and the purse holder is in use. The support legs are fabricated such that they will easily accept at least one pair of shoes while allowing air to freely circulate in and out of the shoes.

One of the hanger assemblies is designed to accept a women's blazer. The opposing second hanger assembly performs two functions. First, it allows a skirt to be free hung without fear of wrinkling or touching the ground. Second, a blouse may also be freely hung and allowed to air out before being returned to the closet for storage. To accomplish these two functions, the second hanger assembly must first be vertically positioned high enough that a full length skirt can hang freely from the waistband (i.e., not requiring that the skirt be folded) without having the skirt touch the ground. In addition, the second hanger assembly must allow the blouse to be hung over the skirt. This is accomplished by providing a hanger having attached to its underside at least two skirt clips. These skirt clips removably engage the waist band area of a skirt and allow it to freely hang lengthwise without the need for folding. The skirt clips comprise any temporary clamping device that will securely hold clothing fabric yet not damage the fabric. A preferred skirt clip is a spring loaded clamp conventionally used in the clothing industry and that can be opened easily using the fingers of one hand.

The skirt clips may be attached directly to a horizontal support member which has attached to it a conventional closet type hanger hook. The horizontal support member could be removably attached to the underside of the hanger in order that the skirt could be removed from the hanger and either be hung on a conventional closet pole or attached to another hanger, for example, the hanger holding the blazer. In this way, the hanging skirt can be removed from the valet stand independent of the hanger supporting the blouse and hung by itself in a closet. Likewise, both hanger assemblies may be designed to be removably connected to its respective support member and may have attached a conventional closet type hanger hook. Again, this would allow each hanger assembly to be easily removed from the support member and hung in a closet. Any type of quick release mechanism could be used to attach the hanger assemblies to the support members, preferably a spring loaded pin device that would allow for easy one-handed operation. Alternatively, the hanger assemblies could themselves hang from the support member in a manner similar to the way a conventional hanger hangs on a closet pole.

Depending on the materials of construction used, it is possible that one of the support members may be fabricated from and be an integral extension of the central vertical support structure. Likewise, the purse holder may be fabricated from and be an integral part of the second support member. In any event, it is preferred that the purse holder be positioned on the same side of the valet as the first hanger assembly designed to accept the first articles of clothing to be removed, usually, the blazer.

In the normal course of using the valet of this invention, a women would first hang her purse on the purse holder, then remove her shoes and hang them on the shoe rack. She would next remove her blazer and hang it on the first hanger assembly attached to the front support. Then she would remove her skirt and attach it to the skirt clips. Finally, she would remove her blouse and hang it on the second hanger assembly. The clothes would then be left on the valet for a period of time so that they could receive a sufficient "airing out" before being put away in a closet.

DETAILED DESCRIPTION OF A PREFERRED EMBODIMENT

Figure 1:
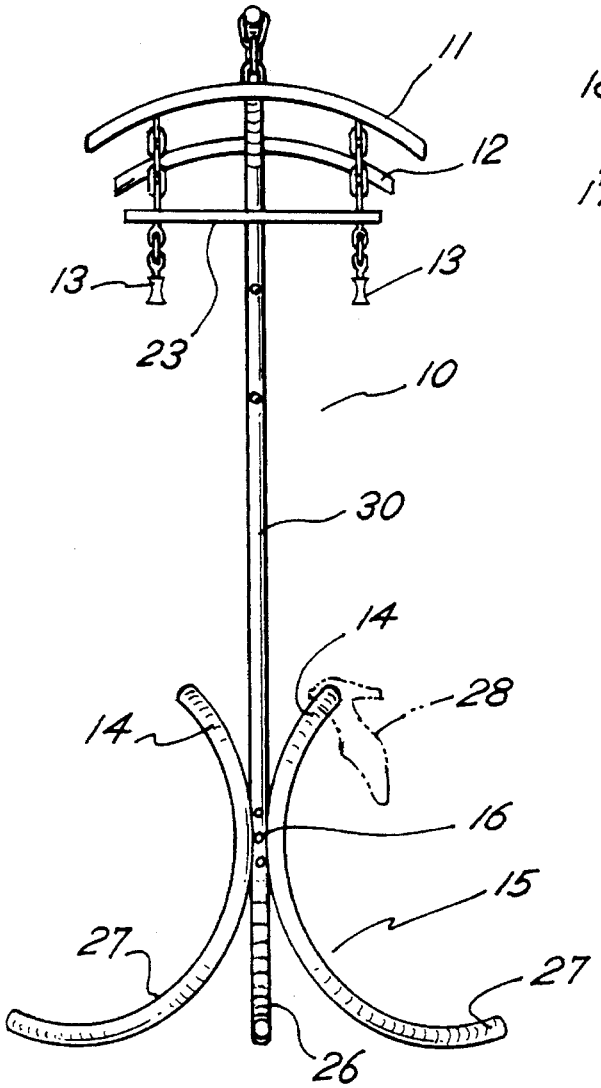
FIG. 1 is an elevation of one embodiment of the entire valet.
Figure 2:
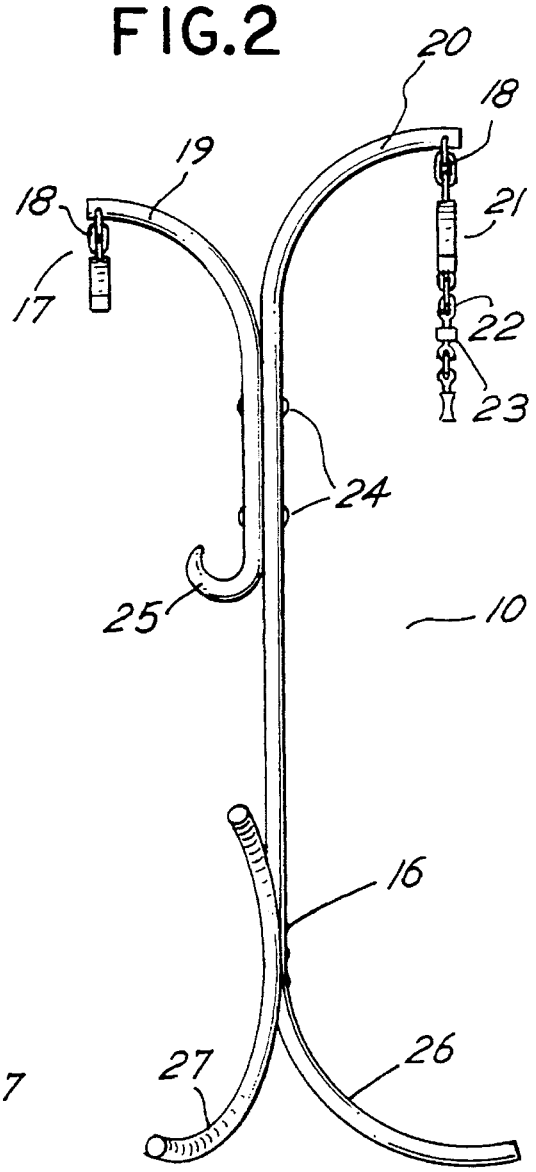
FIG. 2 is a side view of same.

One embodiment of the valet of this invention is shown in FIGS. 1 and 2 at 10 and includes a central vertical support structure 30 having an upper section and a lower section. Attached to the upper section by fasteners 24 is front support 19 having at its lower end a purse hanger 25. Purse hanger 25 is in the shape of a hook to receive and support the strap or handles of a women's purse and is positioned on the central vertical support structure at a sufficient vertical height so that an average style purse will not touch the ground. The upper section also has a rear support 20 that is fabricated from and is an integral part of the central vertical support structure 30. Both the front and rear supports are cantilevered outwardly from the central vertical support structure 30 and have attached to each hanger assemblies 17 and 21. Each hanger assembly is connected to its respective support member through uppermost chain-like connectors 18.

Hanger assembly 17 has a hanger 12 fashioned in a shape to adequately support a blazer. Hanger 12 is fabricated of wood, metal, plastic or a combination thereof. As mentioned, hanger 12 may be removable from front support 19 and have attached a conventional hanger hook to allow it to hang on a closet pole. Hanger assembly 21 likewise has a hanger 11 that is fashioned in a shape to adequately support a blouse or other light weight women's garment worn under a blazer. Hanger 11 can be fabricated of wood, metal, plastic or a combination thereof. Attached to the underside of hanger 11 is at least two chain like connectors 22 which are in turn attached to horizontal support 23. Horizontal support 23 has attached to its underside a skirt attachment comprising at least two skirt clips 13. Connectors 22 may be removable from hanger 11 and capable of attachment to the underside of hanger 12 or any other similarly designed hanger. In this way, a skirt and matching blazer can be hung together in a closet for later use.

The valet 10 is stabilized and kept vertical by supporting legs 15. At least one supporting leg 26 is an integral part of the lower portion of the central vertical support structure 30. Additional supporting legs 27 are fastened to the central vertical support structure 30 through fasteners 16. Fasteners 16 and 24 can be rivets, screws, bolts, welds or any other fastener means known to the art. The upper portions of the additional supporting legs 27 project outwardly from the central vertical support structure 30 to form shoe rack 14. FIG. 1 illustrates how a shoe 28 is supported on shoe rack 14.

Having fully described the valet of this invention, it is to be understood that the invention is not to be limited to the details set forth above, as such an embodiment was presented for illustrative purposes only, and was not intended to limit the scope of the invention of this application which is defined in the following claims.

I claim:

1. A valet comprising an upper portion and a lower portion, said upper portion having a front support and a rear support, said front support having a first clothes hanger assembly and a purse holder, said rear support having a second clothes hanger assembly and a skirt attachment having at least two clips, and said lower portion having attached supporting legs and a shoe rack.

2. The valet of claim 1, wherein at least a part of the first and second hanger assemblies are removable from the valet.

3. The valet of claim 1, wherein the first and second hanger assemblies have hangers that can be removed from the valet and hung on a closet clothing pole.

4. The valet of claim 1, wherein the skirt attachment is suspended from and attached to the second hanger assembly.

5. The valet of claim 1, wherein the clips are attached to a horizontal support.

6. The valet of claim 4, wherein the skirt attachment is removably attached to the second hanger assembly and can be removably attached to the first hanger assembly.

7. A women's clothing valet comprising a central vertical support structure having a cantilevered upper support member and a support leg, a front support fixedly attached to the central vertical support structure and having a cantilevered upper portion and a purse holder, the front support having a first hanger removably attached to the cantilevered upper portion, the cantilevered upper support having a removably attached second hanger and at least two skirt clips attached to the second hanger, and at least three supporting legs fixedly attached to the central vertical support structure equally spaced around the central vertical support structure opposite to and adjacent to the support leg to stabilize and allow the valet to be free standing.

* * * * *